US008028992B2

(12) United States Patent
Terao

(10) Patent No.: US 8,028,992 B2
(45) Date of Patent: Oct. 4, 2011

(54) RECORDING SHEET TRANSPORTING APPARATUS AND IMAGE FORMING APPARATUS

(75) Inventor: Akira Terao, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 84 days.

(21) Appl. No.: 12/549,697

(22) Filed: Aug. 28, 2009

(65) Prior Publication Data

US 2010/0052244 A1 Mar. 4, 2010

(30) Foreign Application Priority Data

Aug. 29, 2008 (JP) ..... 2008-220834

(51) Int. Cl.
*B65H 5/06* (2006.01)

(52) U.S. Cl. ..... 271/273

(58) Field of Classification Search ..... 403/57; 464/120, 151, 158.06; 271/272–274
See application file for complete search history.

(56) References Cited

U.S. PATENT DOCUMENTS

| | | | | |
|---|---|---|---|---|
| 6,059,280 | A * | 5/2000 | Yamauchi et al. | 271/109 |
| 6,267,373 | B1 * | 7/2001 | Takata | 271/274 |
| 2007/0147875 | A1 | 6/2007 | Hattori | |

FOREIGN PATENT DOCUMENTS

| | | |
|---|---|---|
| JP | 06-161317 | 6/1994 |
| JP | 07-261590 | 10/1995 |
| JP | 2000-072276 | 3/2000 |
| JP | 2000-095394 | 4/2000 |
| JP | 2001-134028 | 5/2001 |
| JP | 2006-315775 | 11/2006 |
| JP | 2007-169024 | 7/2007 |
| JP | 2007-292794 | 11/2007 |

OTHER PUBLICATIONS

Notice of Reasons for Rejection for corresponding Japanese Patent Application 2008-220834 mailed on Jun. 1, 2010.

* cited by examiner

*Primary Examiner* — Michael McCullough
(74) *Attorney, Agent, or Firm* — Banner & Witcoff, Ltd.

(57) ABSTRACT

A recording sheet transporting apparatus includes a first roller which transports a recording sheet, a first transmitting gear to which a drive force is transmitted from a drive source, a second roller which is movable in a radial direction with respect to the first roller, a second transmitting gear which is engaged with the first transmitting gear and which transmits the driving force to the second roller, a universal joint which connects an end portion of the second roller and one end portion of the second transmitting gear, a bearing member which has a cylindrical surface and rotatably supports the other end portion of the second transmitting gear by the cylindrical surface, and a supporting member which tiltably supports the bearing member in a movement direction of the second roller.

14 Claims, 7 Drawing Sheets

RECORDING SHEET TRANSPORTING APPARATUS AND IMAGE FORMING APPARATUS

CROSS REFERENCE TO RELATED APPLICATION

The present application claims priority from Japanese Patent Application No. 2008-220834, filed on Aug. 29, 2008, the disclosure of which are incorporated herein by reference in its entirety.

BACKGROUND OF THE INVENTION

1. Field of the Invention

The present invention relates to a recording sheet transporting apparatus which transports a recording sheet, and an image forming apparatus which includes the recording sheet transporting apparatus.

2. Description of the Related Art

Generally, as a recording sheet transporting apparatus, a fixing apparatus which transports a recording sheet through a heating roller which carries out thermal fixing of a developer image printed on the recording sheet and a pressurizing roller that is pressed to contact with the heating roller has hitherto been known. As such fixing apparatus, a fixing apparatus, in which the pressurizing roller is coupled with a motor via a universal joint so as to transmit a driving force to the pressurizing roller which moves back and forth in a radial direction of the heating roller, has been known (refer to Japanese Patent Application Laid-open No. 6-161317).

Concretely, in this technology, by providing an intermediate shaft between a shaft of the heating roller and a drive shaft to which the driving force is transmitted by the motor, and by providing universal joints between both ends of the intermediate shaft and the shafts, respectively, the driving force from the motor is transmitted to the pressurizing roller even when the shaft of the pressurizing roller has shifted from the pressurizing roller of the drive shaft.

However, in the abovementioned technology, as the intermediate shaft is provided between the shaft of the pressurizing roller and the drive shaft, and since two universal joints are necessary, a size of the apparatus becomes large in an axial direction.

SUMMARY OF THE INVENTION

In view of the abovementioned circumstances, an object of the present invention is to provide a recording sheet transporting apparatus in which a mechanism, which transmits the driving force to one roller movable in a radial direction of the other roller, is improved to make the size of the apparatus in the axial direction small, and an image forming apparatus which includes the recording sheet transporting apparatus.

According to a first aspect of the present invention, there is provided a recording sheet transporting apparatus which transports a recording sheet by transmitting a driving force from a drive source to the recording sheet, including: a first roller which transports the recording sheet; a second roller which is movable in a radial direction thereof with respect to the first roller; a first transmitting gear which transmits the driving force from the drive source to the first roller; a second transmitting gear which is engaged with the first transmitting gear, and which transmits the driving force to the second roller; a universal joint which connects an end portion of the second roller and one end portion of the second transmitting gear; a bearing member which has a cylindrical surface and which rotatably supports the other end portion of the second transmitting gear by the cylindrical surface; and a supporting member which supports the bearing member tiltably in a movement direction of the second roller.

According to the first aspect of the present invention, since the second transmitting gear, which is coupled with the second roller via the universal joint and which is engaged with the first transmitting gear, is supported by the tiltable bearing member, it is not necessary to provide an intermediate shaft as it has hitherto been provided. Moreover, since one universal joint serves the purpose, it is possible to make a size small in an axis direction. Since the present invention has a structure in which the gear (the second transmitting gear) is tiltable, it is possible to transmit the driving force favorably by setting height of gear teeth such that the engagement of the second transmitting gear and the first transmitting gear is maintained even when the second transmitting gear is somewhat tilted.

According to a second aspect of the present invention, there is provided a recording sheet transporting apparatus which transports a recording sheet by transmitting a driving force from a drive source to the recording sheet, including: a first roller which transports the recording sheet; a second roller which is movable in a radial direction thereof with respect to the first roller; a first transmitting gear which drives the first roller; a second transmitting gear which is engaged with the first transmitting gear, and which drives the second roller; a universal joint which connects an end portion of the second roller and one end potion of the second transmitting gear; a bearing member which rotatably supports the other end portion of the second transmitting gear; and a supporting member which supports the bearing member tiltably in a movement direction of the second roller.

Even according to the second aspect of the present invention, the second transmitting gear, which is coupled with the second roller via the universal joint and which is engaged with the first transmitting gear, is supported by the tiltable bearing member. Accordingly, it is not necessary to provide an intermediate shaft as it has hitherto been provided. Moreover, since one universal joint serves the purpose, it is possible to make a size small in an axis direction.

DETAILED DESCRIPTION OF THE PREFERRED EMBODIMENTS

Figure 1:
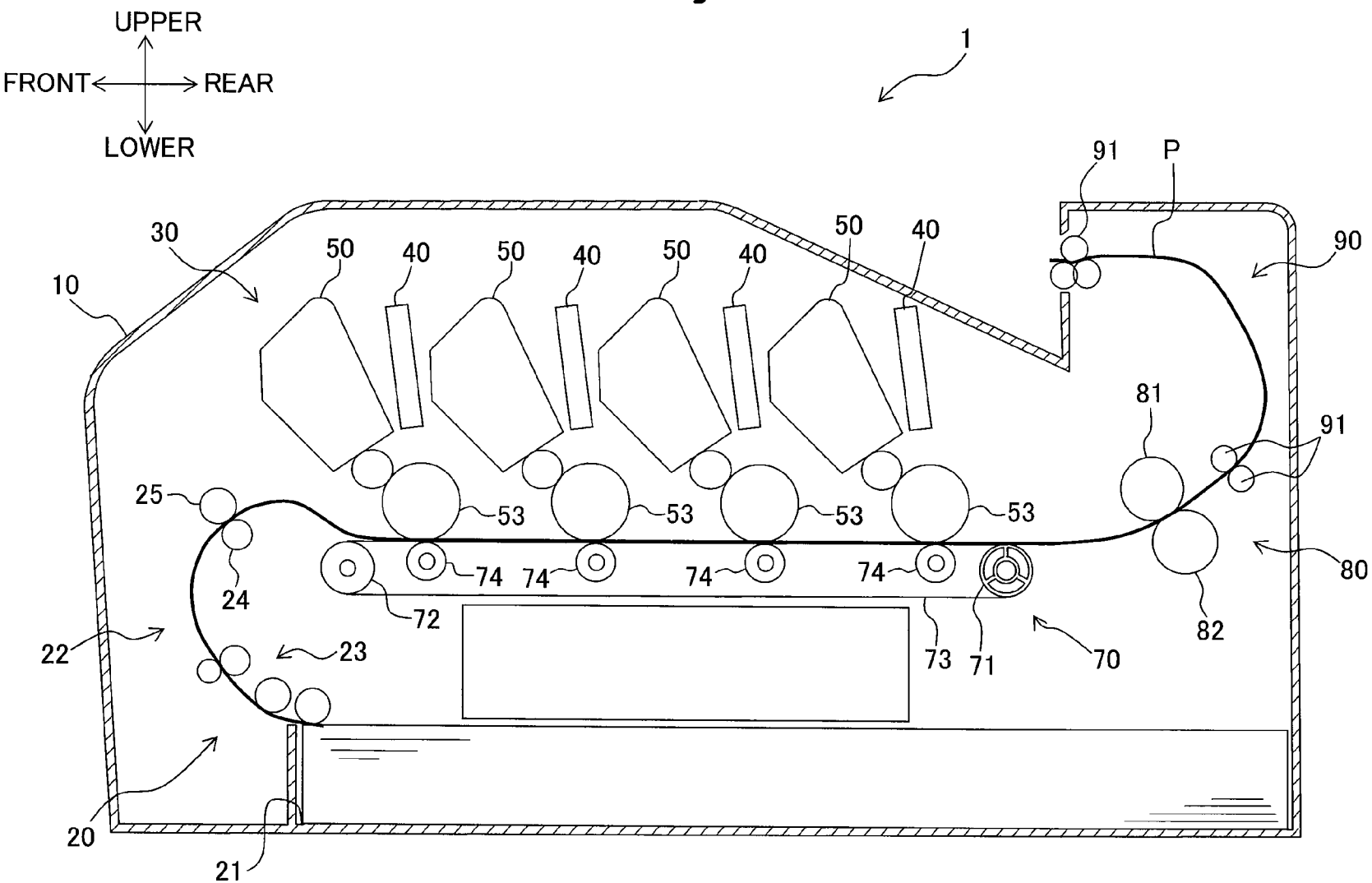
FIG. 1 is a cross-sectional view showing an overall structure of an electrophotographic color printer.

An embodiment of the present invention will be described below in detail while referring to the accompanying diagrams. In the diagrams to be referred to, FIG. 1 is a cross-sectional view showing an overall structure of an electrophotographic color printer. In the following description, after describing the overall structure of the color printer first of all, features of the present invention will be described in detail.

In the following description, directions are determined by referring to a user at the time of using the color printer as a basis. In other words, in FIG. 1, a left side with respect to the paper surface is referred to as a "front side", a right side with respect to the paper surface is referred to as a "back side", a back side with respect to the paper surface is referred to as a "left side", and a front side with respect to the paper surface is referred to as a "right side". Moreover, an upward direction and a downward direction with respect to the paper surface are referred to as an "upward direction" and a "downward direction", respectively.

As shown in FIG. 1, a color printer 1 includes, inside a main-body casing 10, a paper feeding section 20 which supplies a paper P as a recording sheet, an image forming section 30 which forms an image on the supplied paper P and a paper discharge section 90 which discharges the paper P with an image formed thereon.

The paper feeding section 20 includes mainly a paper feeding tray 21 which accommodates papers P and a paper transporting unit 22 as a recording sheet transporting apparatus which transports the paper P from the paper feeding tray 21 to the image forming section 30. The paper transporting unit 22 includes a known paper feeding mechanism 23 provided with rollers, such as a separating roller and a paper-dust removing roller, a pinch roller 25 as a first roller which transports the paper P and a resist roller 24 as a second roller movable in a radial direction with respect to the pinch roller 25.

The resist roller 24 is a roller for setting a position of a front edge throughout a width direction of the paper P to a regular position when the paper P has advanced in inclined manner with respect to a transporting direction. In other words, the resist roller 24 adjusts the direction of front edge of the paper P to a regular direction (transporting direction). The pinch roller 25 is a roller which pinches the paper P with the resist roller 24, and is arranged in a front and upward direction with respect to the resist roller 24. Moreover, the resist roller 24 is pressed to contact with the pinch roller 25. A structure around the resist roller 24 will be described later in detail.

In the paper feeding section 20 which is formed as described above, the papers P in the paper feeding tray 21 are sent one-by-one to the resist roller 24 at an upper side, upon being separated by the paper feeding mechanism 23. After setting the front end of the paper P, the resist roller 24 sends the paper P on to a transporting belt 73 which will be described later.

The image forming section 30 includes mainly four LED units 40, four process cartridges 50, a transfer unit 70, and a fixing unit 80.

The LED unit 40 has a plurality of LEDs, and exposes a photosensitive drum 53 which will be described later.

The process cartridges 50 are arranged in line in the frontward and the rearward direction, and each of the process cartridges 50 includes the photosensitive drum 53, a charger which is not shown in the diagram, and other known components such as a developing roller, and a toner accumulating chamber.

The transfer unit 70 is provided between the paper feeding section 20 and each process cartridge 50, and includes mainly a drive roller 71, a driven roller 72, the transporting belt 73, and a transfer roller 74.

The drive roller 71 and the driven roller 72 are arranged in parallel to be separated in the frontward and the rearward direction, and the transporting belt 73 which is an endless belt is put around the drive roller 71 and the driven roller 72. An outer surface of the transporting belt 73 makes a contact with each photosensitive drum 53. Moreover, four transfer rollers 74, each pinching the transporting belt 73 between the photosensitive drum 53 and the transfer roller 74, are arranged at an inner side of the transporting belt 73, facing the four photosensitive drums 53 respectively. A transfer bias is applied to the transfer rollers 74 by a constant current control at the time of transferring.

The fixing unit 80 is arranged at a back side of the process cartridges 50 and the transfer unit 70, and includes a heating roller 81 and a press roller 82 which is arranged facing the heating roller 81, and which presses against the heating roller 81.

In the image forming section 30 structured in such manner, firstly, a surface of each photosensitive drum 53 is charged uniformly by the charger, and then exposed by each LED unit 40. Accordingly, an electric potential of an exposed portion is decreased, and an electrostatic latent image based on image data is formed on each photosensitive drum 53. Thereafter, a toner image is supported on the photosensitive drum 53 by the toner being supplied to the electrostatic latent image by the developing roller.

When the recording paper P which is supplied to the transporting belt 73 passes between each photosensitive drum 53 and each transfer roller 74, a toner image formed on each photosensitive drum 53 is transferred onto the paper P. Moreover, when the paper P passes between the heating roller 81 and the press roller 82, the toner image transferred onto the paper P is fixed by heating.

The paper discharge section 90 includes mainly a plurality of transporting rollers 91 which transport the paper P. The paper P having the toner image transferred and then subjected to thermal fixing thereon is transported by the transporting rollers 91, and is discharged to an outside of the main-body casing 10.

Figure 2:
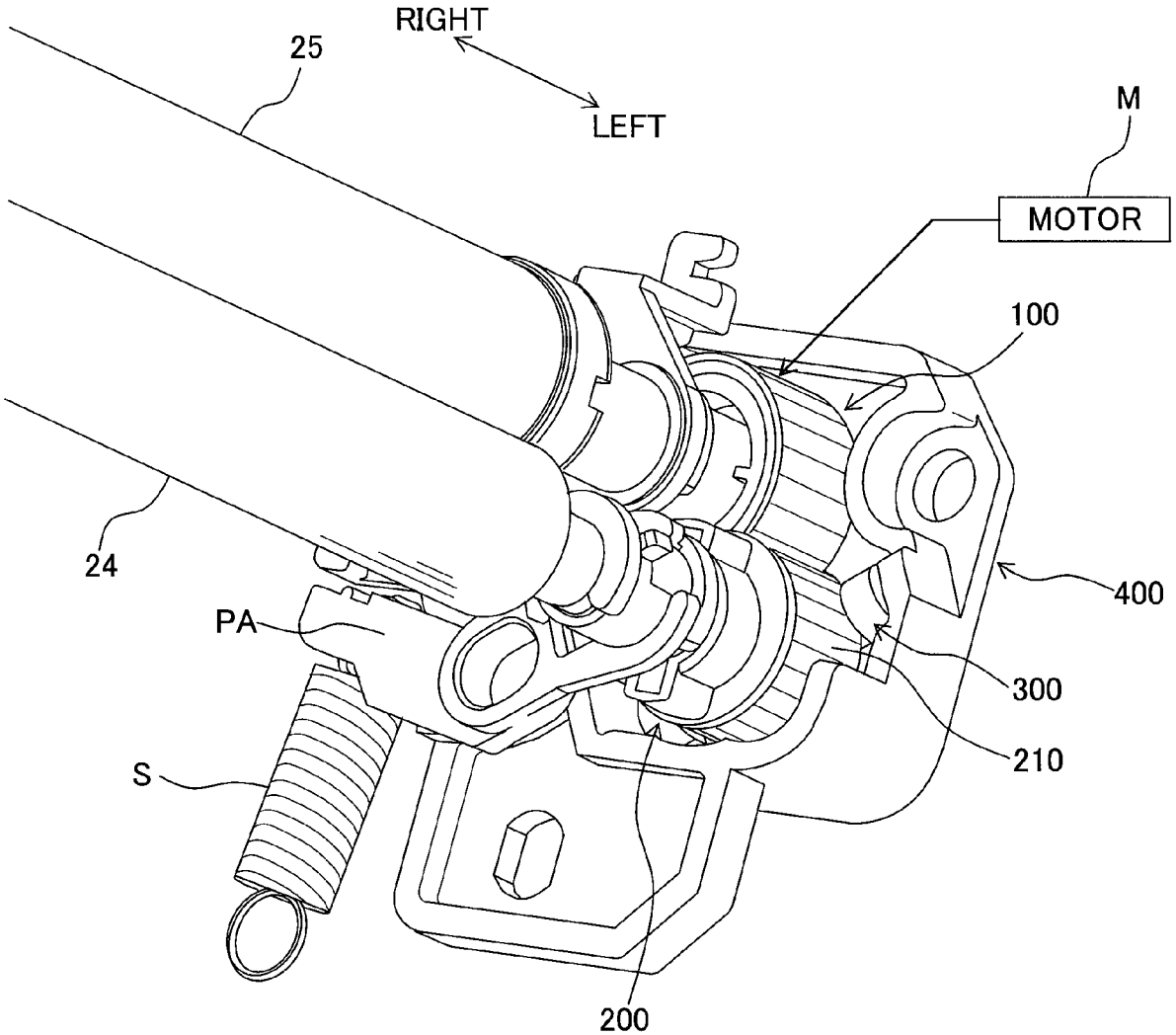
FIG. 2 is a perspective view showing in detail a structure around a resist roller.
Figure 3:
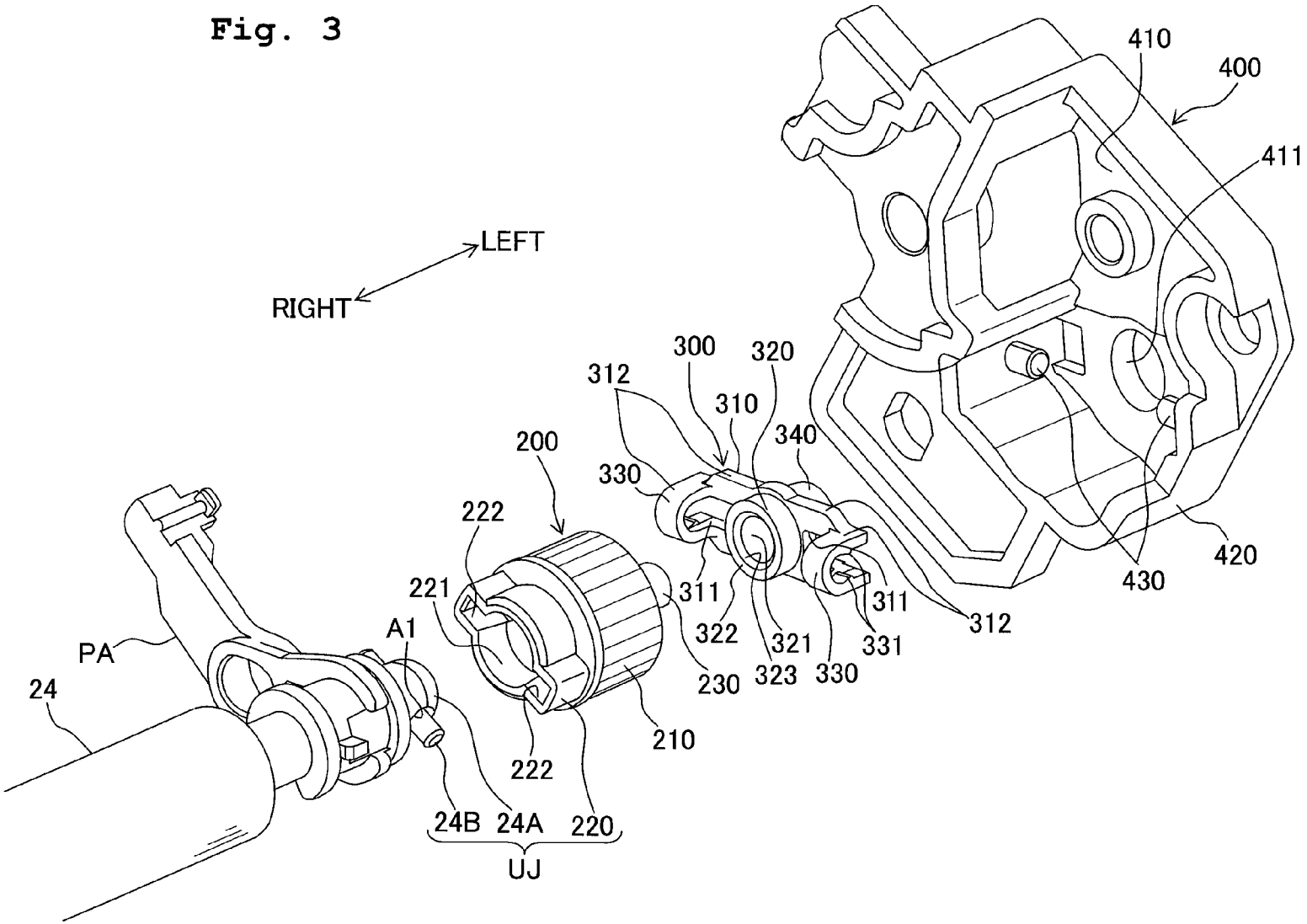
FIG. 3 is an exploded perspective view showing the structure around the resist roller.
Figure 4:
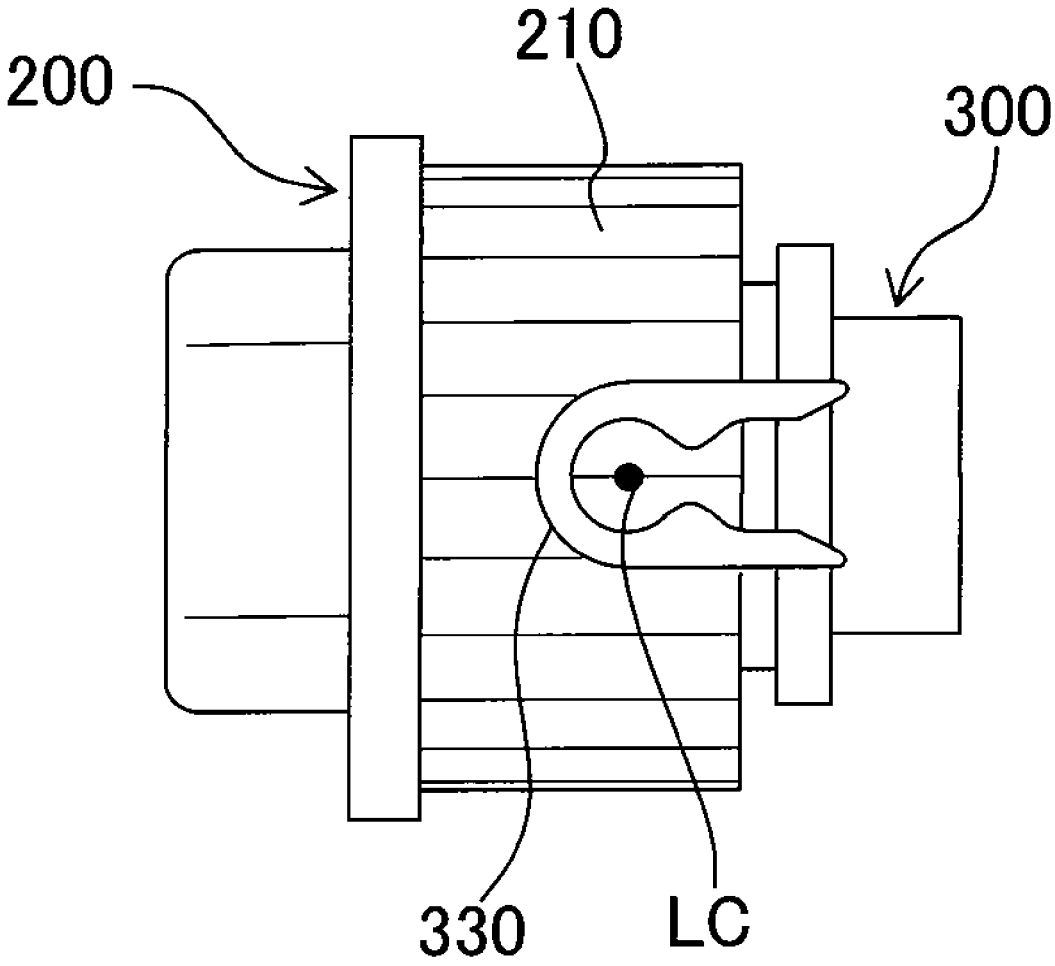
FIG. 4 is a side view showing a state in which a bearing member is fitted together with a second transmitting gear.

Next, a detail structure around the resist roller which is the salient feature of the present invention will be described below. In the diagrams to be referred to, FIG. 2 is a perspective view showing in detail the structure around the resist roller, and FIG. 3 is an exploded perspective view showing the structure around the resist roller when disassembled. Moreover, FIG. 4 is a side view showing a state in which a bearing member is fitted together with a second transmitting gear.

Figure 5A:
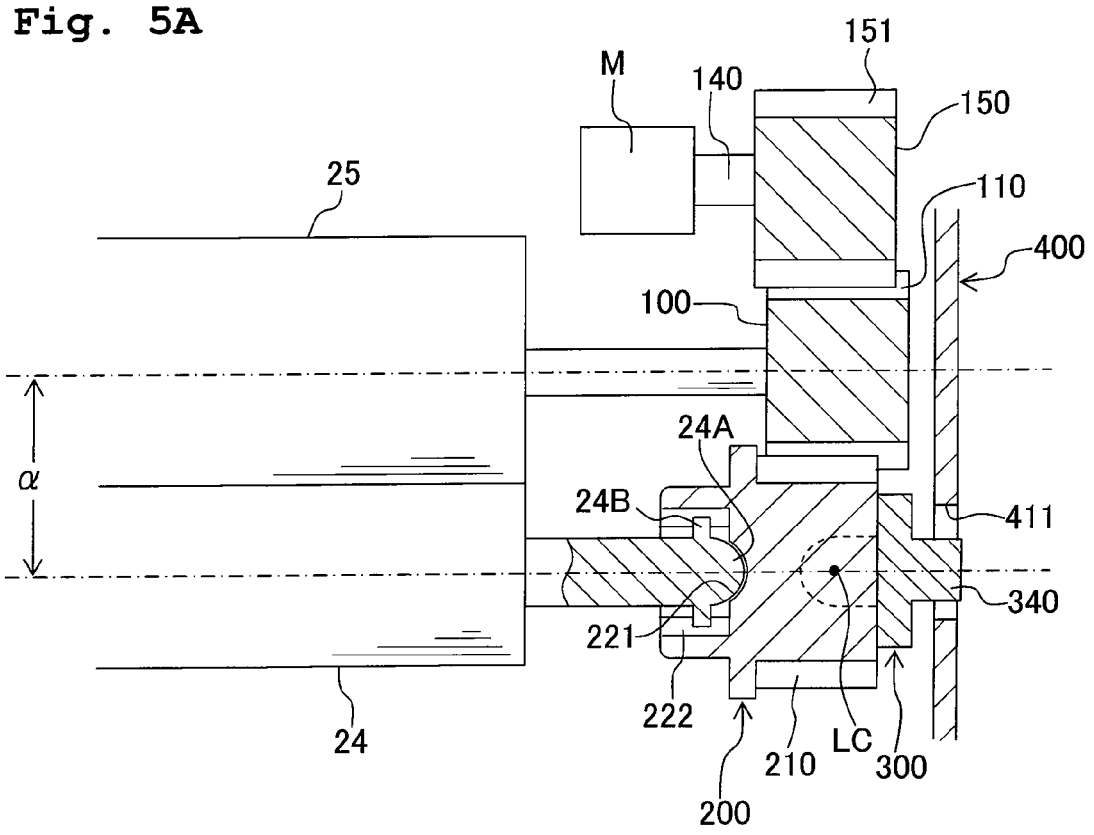
FIG. 5A is an explanatory diagram showing a state of each member when a distance between an axis of the resist roller and an axis of the pinch roller is $\alpha$.

As shown in FIG. 2 and FIG. 5A, a first transmitting gear 100, to which the driving force is transmitted from a motor M as a drive source via a gear 150, is fixed to the pinch roller 25. Concretely, the gear 150 is provided at an end portion of a drive shaft 140 of the motor M. The gear 150 is coupled with the drive shaft 140, and rotates with the drive shaft 140 as an axis of rotation. The gear 150 has a gear portion 151 which is engaged with a gear portion 110 of the first transmitting gear 100. Therefore, when the motor M undergoes a rotational drive, the gear 150 rotates, thereby rotating the first transmitting gear 100 engaged with the gear 150. The pinch roller 25 rotates by the rotation of the first transmitting gear 100. As it has been described above, the driving force from the motor M as a drive source is transmitted to the pinch roller 25 via the first transmitting gear 100.

The resist roller 24 is biased by a known pressing arm PA or a tension spring S, toward the pinch roller 25. A pivot portion 24A having a spherical shape is formed at a left end of the resist roller 24 as shown in FIG. 3. A hole A1 which is a through hole in a radial direction of the resist roller 24 is formed through the spherical-shaped pivot portion 24A, and an engaging pin 24B of which both ends protrude from the pivot portion 24A is fixed in the hole A1. Moreover, a second transmitting gear 200, a bearing member 300, and a supporting member 400 are arranged at a left side of the resist roller 24.

The second transmitting gear 200 has a gear portion 210 which is engaged with the gear portion 110 of the first transmitting gear 100, a connecting portion 220 which is formed to be protruded toward right from a right-end surface (one-end surface) of the gear portion 210, and a rotating-shaft portion 230 which is formed to be protruded toward left from a left-end surface (the other-end surface) of the gear portion 210. Since the gear portion 210 of the second transmitting gear 200 is engaged with the gear portion 110 of the first transmitting gear 100, the driving force from the motor M is transmitted to the first transmitting gear 100, and by the rotation of the first transmitting gear 100, the second transmitting gear 200 also rotates.

The connecting portion 220 is combined with the above-mentioned pivot portion 24A and the engaging pin 24B to form a universal joint UJ. Concretely, the connecting portion 220 has a pivot accommodating portion 221 which accommodates the pivot portion 24A of the resist roller 24, and two pin accommodating portions 222 which accommodate two end portions respectively of the engaging pin 24B protruding from the pivot portion 24A.

The pivot accommodating portion 221 is formed to be substantially circular cylindrical shape having a bottom, and the bottom surface thereof is formed to be hemispherical. Therefore, the pivot portion 24A is turnable inside the pivot accommodating portion 221.

The pin accommodating portion 222 is a wall having a shape of an English alphabet "U" in a cross-sectional view which is formed integrally with the pivot accommodating portion 221 to protrude toward an outside in a radial direction from the pivot accommodating portion 221. The pin accommodating portion 22 has a groove (a groove which is longer than a radius of the engaging pin 24B in an axial direction of the second transmitting gear 200) opening from an inner side to a right side of the pivot accommodating portion 221. Therefore, in the pin accommodating portion 222, both end portions of the engaging pin 24B are movable in the axial direction of the second transmitting gear 200, and are engaged with the wall of the pin accommodating portion 222 in a circumferential direction of the second transmitting gear 200. Moreover, by the pin accommodating portion 222 and both end portions of the engaging pin 24B being engaged in such manner, the driving force is transmitted from the second transmitting gear 200 to the resist roller 24.

The bearing member 300 has a base potion 310 having a long shape and extending along a radial direction of the second transmitting gear 200, a bearing portion for rotation 320 having a bottomed circular cylindrical shape and protruding toward right from a central portion of the base portion 310, a bearing portion for tilting 330 which is formed one each at both end portions of the base portion 310, and an engaging shaft portion 340 which is protruded toward left from the central portion of the base portion 310.

A recess portion 311 which is dented toward the central portion of the base portion 310 is formed at both end edges of the base portion 310.

The bearing portion for rotation 320 has a circular cylindrical surface 321 which rotatably supports the rotating-shaft portion 230 of the second transmitting gear 200. Moreover, an angular portion formed by the circular cylindrical surface 321 and a front end portion 322 is chamfered to form a taper surface 323, and accordingly, the rotating-shaft portion 230 of the second transmitting gear 200 is guided into the bearing portion for rotation 320.

The bearing portion for tilting protrudes toward right from both end portions of the base portion 310, has a shape of an English alphabet U in a cross-sectional view, and opens toward left. At an appropriate location on an inner surface of the bearing portion for tilting 330, two engaging projections 331 which are engaged with a supporting shaft 430 of a supporting member 400 which will be described later are formed to face with each other. Accordingly, the bearing member 300 is tiltable with respect to the supporting member 400, in a state of the supporting shaft 430 fitted between each engaging projection 331 and a bottom surface portion of the U-shaped bearing portion for tilting 330.

Moreover, an opening end portion of the bearing portion for tilting 330 is integrally connected to an opening end portion of the recess portion 311 of the base portion 310. Therefore, at the time of installing the bearing portion for tilting 330 on the supporting shaft 430 of the supporting member 400, the opening end portion of the bearing portion for tilting 330 is spread upon bending in a favorable manner, and the engaging projection 331 is easily engaged with the supporting shaft 430.

The bearing portion for tilting 330 formed in such manner overlaps with the gear portion 210 of the second transmitting gear 200 when viewed from the radial direction of the second transmitting gear 200, in a state of the bearing member 300 and the second transmitting gear 200 assembled, as shown in FIG. 4. Accordingly, a tilting center LC of the bearing member 300 is arranged within a tooth width (within a width in the axial direction of the second transmitting gear 200). Moreover, the second transmitting gear 200 supported by the bearing member 300 is tilted with the tilting center LC in the tooth width of the gear portion 210 as a center. In other words, the bearing member 300 has arms 312 which extend toward both sides in a radial direction from the center of the base portion 310 (extending portions which extend from a center of the base portion 310 toward the second transmitting gear 220, so as to sandwich the second transmitting gear 200), and each of which is curved in a direction of the second transmitting gear 200 and has the bearing portion for tilting 330 at an end portion. Accordingly, it is possible to position the two supporting shafts 430 of the supporting member 400, which will be described later, not in the bearing member 300 but in the second transmitting gear 200 in the axial direction of the second transmitting gear 200.

As shown in FIG. 3, the supporting member 400 has a bottom wall portion 410, a peripheral wall 420 which is projected toward right from the bottom wall portion 410, surrounding the bearing member 300, and the two supporting shafts 430. The two supporting shafts 430 are formed to face with each other at appropriate locations of the peripheral wall 420 so as to tiltably support the bearing member 300 in the movement direction of the resist roller 24 (movement direction with respect to the pinch roller 25). In other words, the two supporting shafts 430 are orthogonal to the rotating-shaft portion 230 of the second transmitting gear 200. Moreover, a long groove 411 which regulates a movement of the engaging shaft portion 340 in the movement direction of the resist roller 24 is formed to be engaged with the engaging shaft portion 340 (a part thereof) of the bearing member 300 in the bottom wall portion 410.

Figure 5B:
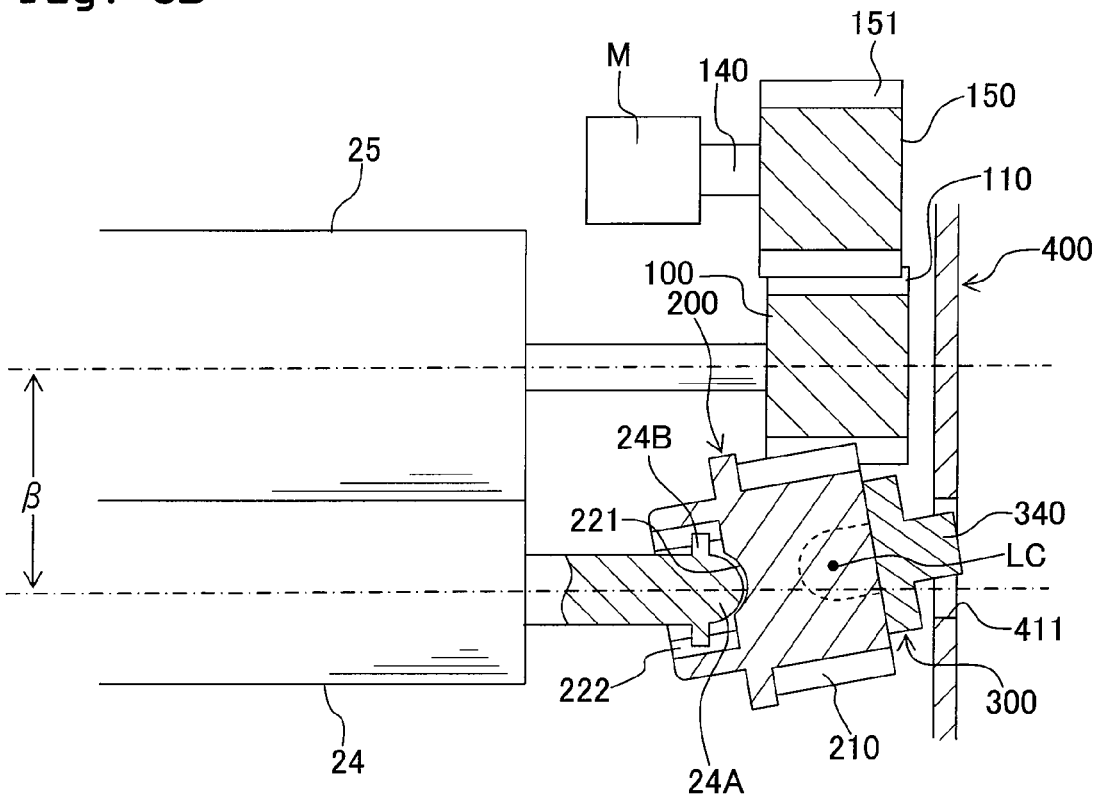
FIG. 5B is an explanatory diagram showing a state of each member when the distance between the axis of the resist roller and the axis of the pinch roller is $\beta$ which is greater than $\alpha$.

Next, a movement of each member when the driving force is transmitted from the motor M to the resist roller 24 will be described below. In the diagrams to be referred to, FIG. 5A is an explanatory diagram showing a state of each member when a distance between the axis of the resist roller 24 and the axis of the pinch roller 25 is α. FIG. 5B is an explanatory diagram showing a state of each member when the distance between the axis of the resist roller 24 and the axis of the pinch roller 25 is β which is greater than α. In FIG. 5A and FIG. 5B, each member is simplified for convenience.

As shown in FIG. 5A, when the distance between the axis of the resist roller 24 and the axis of the pinch roller 25 is α (when the axis of the second transmitting gear 200 is parallel to the axis of the first transmitting gear 100), as the driving force is inputted from the motor M to the first transmitting gear 100, the pinch roller 25 rotates integrally with the first transmitting gear 100, and the driving force is transmitted to the second transmitting gear 200 engaged with the first transmitting gear 100. Thereafter, by the engaging pin 24B being pressed by the pin accommodating portion 222 of the second transmitting gear 200, the driving force is transmitted to the resist roller 24, and the resist roller 24 rotates.

As shown in FIG. 5B, when the distance becomes β which is greater than α (in a case of printing a board paper), the pivot accommodating portion 221 of the second transmitting gear 200 is pressed by the pivot portion 24A of the resist roller 24 which moves away from the pinch roller 25 in the radial direction, and the second transmitting gear 200 is tilted with the tilting center LC as a center. At this time, the engagement of the first transmitting gear 100 and the second transmitting gear 200 is maintained, and the engagement of the engaging pin 24B and the pin accommodating portion 222 of the second transmitting gear 200 is also maintained.

Therefore, even when the distance becomes β, the driving force from the motor M is transmitted from the first transmitting gear 100 to the second transmitting gear 200. Thereafter, by the engaging pin 24B being pressed by the wall of the pin accommodating portion 222 of the second transmitting gear 200, the driving force is transmitted to the resist roller 24, and the resist roller 24 rotates.

According to the embodiment described above, it is possible to achieve the following effect. Since the second transmitting gear 200, which is connected to the resist roller 24 via the universal joint UJ and is engaged with the first transmitting gear 100, is supported by the bearing member 300 which is tiltable, it is not necessary to provide an intermediate shaft as in a conventional technology. Further, since one universal joint UJ serves the purpose, it is possible to make the paper transporting unit 22 small and consequently to make the color printer 1 small.

Since the rotating-shaft portion 230 of the second transmitting gear 200 is supported by the circular cylindrical surface 321 of the bearing portion for rotation 320, as compared to a structure in which, the rotating-shaft portion 230 of the second transmitting gear 200 is supported by a spherical surface, it is possible to suppress a point contact (a state in which the spherical shaped pivot portion 24A makes a misaligned contact with the spherical shaped pivot accommodating portion 221 as in FIG. 5A), and to suppress wearing of the bearing portion for rotation 320.

Moreover, it is desirable that a pressure (nip pressure) exerted between the pinch roller 25 and the resist roller 24 is kept to be uniform with respect to the paper P which is transported, and it is necessary to keep the distance between the axis of the pinch roller 25 and the axis of the resist roller 24 while the paper P is transported. However, when the first transmitting gear 100 and the second transmitting gear 200 are engaged, and the first transmitting gear 100 rotates, since a force in a tilting direction of the second transmitting gear 200 (a direction in which the resist roller 24 moves away from the pinch roller 25 in the radial direction) is transmitted to the gear portion 210 of the second transmitting gear 200, the second transmitting gear 200 is tilted, and the distance between the axis of the pinch roller 25 and the axis of the resist roller 24 is fluctuated. In the embodiment, since the tilting center LC of the bearing member 300 is arranged in the tooth width of the gear portion 210 of the second transmitting gear 200, the force transmitted from the first transmitting gear 100 to the gear portion 210 is received by the supporting shaft 430 of the supporting member 400, and hardly acts in the tilting direction of the second transmitting gear 200. Accordingly, since the tilting of the second transmitting gear 200 by the force transmitted from the first transmitting gear 100 is suppressed, it is possible to make the nip pressure uniform by keeping the distance between the axis of the pinch roller 25 and the axis of the resist roller 24 constant.

Since a long groove 411 which regulates the movement of the engaging shaft portion 340 only in the movement direction of the resist roller 24 with respect to the pinch roller 25 by engaging with the engaging shaft portion 340 of the bearing member 300 is formed in the supporting member 400, it is possible to make the tilting direction of the second transmitting gear 200 to be a nip direction (the movement direction of the resist roller 24) assuredly.

Figure 6A:
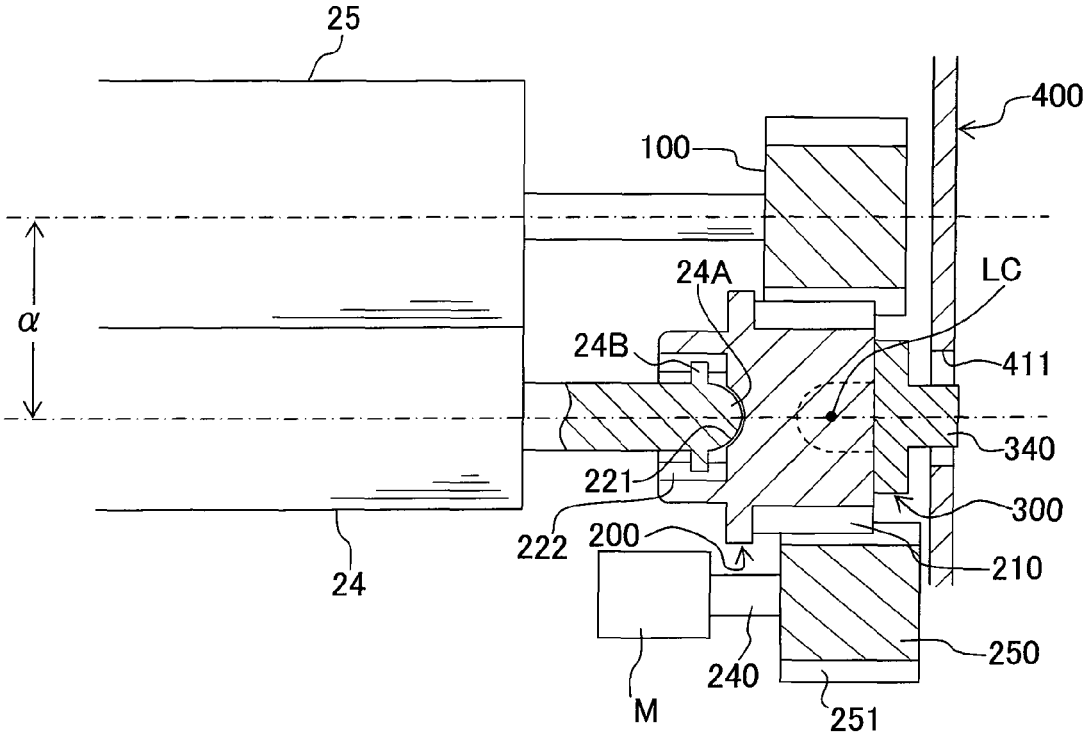
FIG. 6A and FIG. 6B are diagrams corresponding to FIG. 5A and FIG. 5B, of a modified embodiment of an embodiment.
Figure 6B:
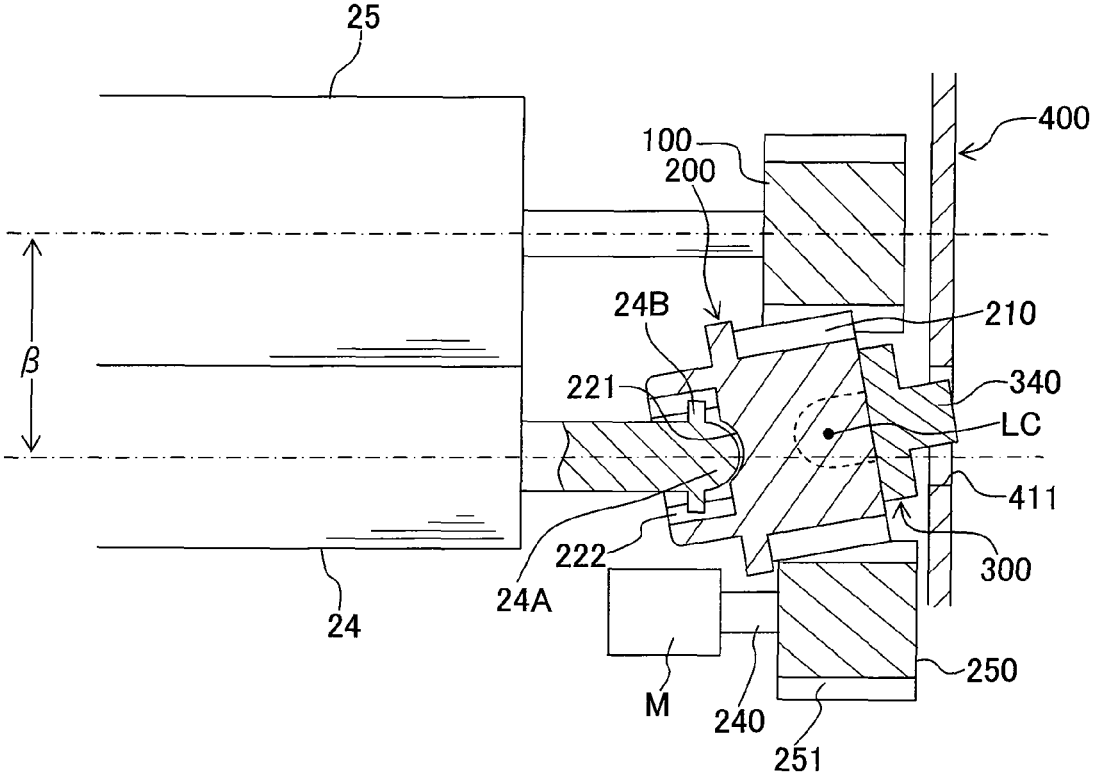

Next, a modified embodiment of the embodiment described above will be described by referring to FIG. 6A and FIG. 6B. In the embodiment, the driving force from the motor M as the drive source has been transmitted to the first transmitting gear 100. However, as shown in FIG. 6A and FIG. 6B, the driving force from the motor M may be transmitted to the second transmitting gear 200. Concretely, the motor M and a gear 250 (drive gear) are arranged such that the gear 250 installed at an end of a drive shaft 240 of the motor M is engaged with the gear portion 210 of the second transmitting gear 200. Accordingly, when the motor M is subjected to rotational drive, a torque of the gear 250 is transmitted to the second transmitting gear 200 which is engaged with the gear 250. Moreover, by the rotation of the second transmitting gear 200, the resist roller 24 rotates via the universal joint UJ. As it has been described above, the driving force from the motor M as a drive source is transmitted to the resist roller 24 via the second transmitting gear 200 and the universal joint UJ. Moreover, since the gear portion 210 of the second transmitting gear 200 is engaged with the gear portion 110 of the first transmitting gear 100, the first transmitting gear 100 rotates due to the rotation of the second transmitting gear 200, thereby making it possible to rotate the pinch roller 25. An arrangement position of the gear 250 with respect to the second transmitting gear 200 and a height (a length in the radial direction) of a gear portion 251 has been adjusted appropriately within a tolerable range of tilting of the second transmitting gear 200. Since the structures of the pinch roller 25, the resist roller 24, the first transmitting gear 100, the universal joint UJ, the second transmitting gear 200, the bearing member 300, and the supporting member 400 are similar as in the embodiment, the detail descriptions thereof are omitted.

As it has been described above, even when a modification is made such that the driving force is transmitted from the motor M to the second transmitting gear 200, since the structures of the pinch roller 25, the resist roller 24, the first transmitting gear 100, the universal joint UJ, the second transmitting gear 200, the bearing member 300, and the supporting member 400 are similar, it is possible to achieve a similar effect as in the embodiment.

The present invention is not restricted to the embodiment and the modified embodiment described above, and it is possible to use various embodiments as described below. In the embodiment, the paper transporting unit 22 in which the resist roller 24 is used has been adopted as a recording sheet transporting apparatus. However, the present invention is not restricted to such an arrangement. For instance, a fixing unit having a pressurizing roller (second roller) which is movable with respect to a heating roller (first roller) as in the conventional technology may be adopted as the recording sheet transporting apparatus.

In the embodiment, the universal joint UJ is formed by the pivot portion 24A, the engaging pin 24B, and the connecting portion 220. However, the present invention is not restricted to such an arrangement. For instance, a universal joint having a different structure, such as a universal joint in the conventional technology (Japanese Patent Application Laid-open No. 6-161317) may be adopted.

Figure 7:
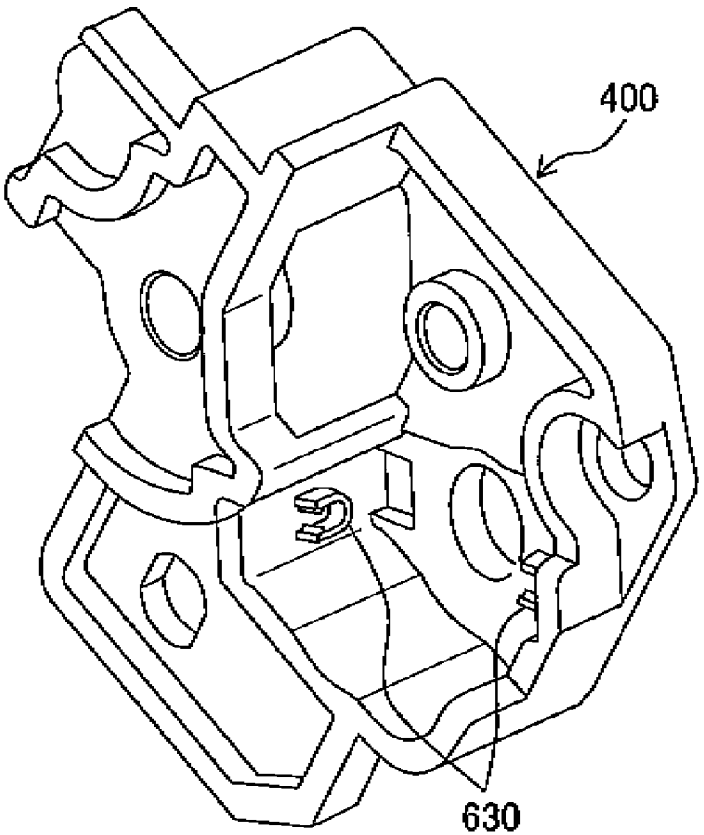
FIG. 7 is an exploded perspective view showing the bearing member and the supporting member of a modified embodiment.
Figure 7:
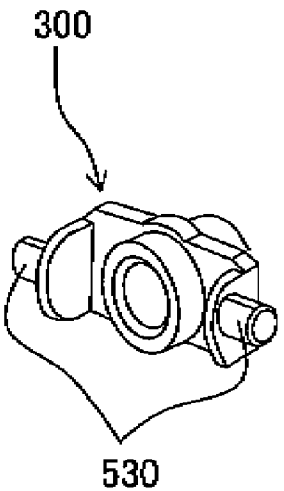

Moreover, in the embodiment, the supporting shafts 430 which support the bearing member 300 have been formed on the supporting member 400, and the bearing portion for tilting 330 which is engaged with the supporting shafts 430 is formed on the bearing portion 300. However, as shown in FIG. 7, tilting shafts 530 of the bearing member 300 may be formed on the bearing member 300, and bearings 630 which are engaged with the tilting shafts 530 of the bearing member 300 and which tiltably support the bearing member 300 may be formed on the supporting member 400.

In the embodiment, since the long groove 41 which is engaged with the part of the engaging shaft portion 340 of the bearing member 300 has been formed in the bottom wall portion 410 of the supporting member 400, it has been possible to regulate assuredly the movement of the engaging shaft portion 340 in the movement direction of the resist roller 24. However, when the tilting of the bearing member 300 having the bearing portion for tilting 330 engaged with the supporting shaft 430 is regulated only in the movement direction of the resist roller 24, by forming the pair of the mutually facing supporting shafts 430 of the supporting member 400 to extend in a direction orthogonal to the movement direction of the resist roller, the long groove 440 of the supporting member 400 and the engaging shaft portion 340 of the bearing member 300 need not be formed.

In the embodiment, for suppressing the wearing of the rotating shaft portion 230 of the second transmitting gear 200, the circular cylindrical surface 321 has been formed on the bearing portion for rotation 320 of the bearing member 300. However, the bearing portion for rotation 320 may be a ball bearing provided that it is possible to suppress the wearing of the rotating shaft portion 230.

Moreover, in the embodiment, the present invention is applied to the electrophotographic color printer 1. However, the present invention is not restricted to such application, and may be applied to other image forming apparatuses such as a multifunction device, a copying machine, and a printer of an ink-jet type. Furthermore, in the embodiment, the paper P such as a board paper, a postcard, and a thin paper has been used as an example of a recording sheet. However, the present invention is not restricted to such papers and an OHP (over head projector) sheet may be used as a recording sheet.

What is claimed is:

1. A recording sheet transporting apparatus configured to transports a recording sheet by transmitting a driving force from a drive source to the recording sheet, comprising:

a first roller configured to transport the recording sheet;

a second roller configured to be movable in a radial direction thereof with respect to the first roller;

a first transmitting gear configured to transmit the driving force from the drive source to the first roller;

a second transmitting gear configured to engage with the first transmitting gear, and to transmit the driving force to the second roller;

a universal joint configured to connect an end portion of the second roller and one end portion of the second transmitting gear;

a bearing member having a cylindrical surface, wherein the bearing member is configured to rotatably support the other end portion of the second transmitting gear by the cylindrical surface; and a supporting member configured to support the bearing member tiltably in a movement direction of the second roller.

2. The recording sheet transporting apparatus according to claim 1, wherein a center of tilting of the bearing member is arranged in a tooth width of the second transmitting gear.

3. The recording sheet transporting apparatus according to claim 1, wherein the supporting member has a long groove formed in the supporting member, wherein the long groove is engaged with a part of the bearing member, and is configured to regulate a movement of the part of the bearing member only in the movement direction of the second roller.

4. The recording sheet transporting apparatus according to claim 1, wherein the second roller is a resist roller configured to set a position of a front edge of the recording sheet, and the first roller is a pinch roller configured to pinch the recording sheet between the resist roller and the pinch roller.

5. The recording sheet transporting apparatus according to claim 1, wherein the supporting member has a supporting shaft formed in the supporting member, wherein the supporting shaft tiltably supports the bearing member in the movement direction of the second roller, and wherein the supporting shaft is orthogonal to a rotation axis of the second transmitting gear.

6. An image forming apparatus comprising:

an image forming section which forms an image on a recording sheet; and a recording sheet transporting apparatus comprising:

a first roller configured to transport the recording sheet;

a second roller configured to be movable in a radial direction thereof with respect to the first roller;

a first transmitting gear configured to transmit a driving force from a driving sorce to the first roller;

a second transmitting gear configured to engage with the first transmitting gear, and to transmit the driving force to the second roller;

a universal joint configured to connect an end portion of the second roller and one end portion of the second transmitting gear;

a bearing member having a cylindrical surface, wherein the bearing member is configured to rotatably support the other end portion of the second transmitting gear by the cylindrical surface; and a supporting member configured to support the bearing member tiltably in a movement direction of the second roller.

7. A recording sheet transporting apparatus configured to transport a recording sheet by transmitting a driving force from a drive source to the recording sheet, comprising:

a first roller configured to transport the recording sheet;

a second roller configured to be movable in a radial direction thereof with respect to the first roller;

a first transmitting gear configured to drive the first roller;

a second transmitting gear configured to engage with the first transmitting gear, and to drive the second roller;

a universal joint configured to connect an end portion of the second roller and one end portion of the second transmitting gear;

a bearing member configured to rotatably support the other end portion of the second transmitting gear; and a supporting member configured to support the bearing member tiltably in a movement direction of the second roller.

8. The recording sheet transporting apparatus according to claim 7, wherein the driving force is transmitted to the first transmitting gear from the drive source.

9. The recording sheet transporting apparatus according to claim 7, wherein the driving force is transmitted to the second transmitting gear from the drive source.

10. The recording sheet transporting apparatus according to claim 7, wherein the bearing member includes a base portion having a bearing portion configured to rotatably support the other end portion of the second transmitting gear and extending portions configured to extend from the base portion toward the second transmitting gear to sandwich the second transmitting gear; a pair of tilting bearings or a pair of tilting shafts is provided on the extending portions; wherein the pair of tilting bearings or the pair of tilting shafts provided on the extending portions are configured to engage with a pair of tilting shafts or a pair of tilting bearings provided on the supporting member, respectively.

11. The recording sheet transporting apparatus according to claim 10, wherein the pair of tilting bearings provided on the extending portions of the bearing member are positioned in the second transmitting gear in a rotation axis direction of the second transmitting gear.

12. The recording sheet transporting apparatus according to claim 7, wherein the supporting member has a long groove formed in the supporting member, wherein the long groove is configured to engage with a part of the bearing member, and to regulate a movement of the part of the bearing member only in the movement direction of the second roller.

13. The recording sheet transporting apparatus according to claim 7, wherein the second roller is a resist roller configured to set a position of a front edge of the recording sheet, and the first roller is a pinch roller configured to pinch the recording sheet between the resist roller and the pinch roller.

14. The recording sheet transporting apparatus according to claim 7, wherein the supporting member has a supporting shaft formed in the supporting member, wherein the supporting shaft tiltably supports the bearing member in the movement direction of the second roller, and wherein the supporting shaft is orthogonal to a rotation axis of the second transmitting gear.

* * * * *